US010349764B2

(12) United States Patent
Rochlin

(10) Patent No.: US 10,349,764 B2
(45) Date of Patent: Jul. 16, 2019

(54) WASHABLE PILLOW WITH MULTIPLE CASES AND REVERSIBLE CORE

(71) Applicant: Scott Karl Rochlin, Bellevue, WA (US)

(72) Inventor: Scott Karl Rochlin, Bellevue, WA (US)

( * ) Notice: Subject to any disclaimer, the term of this patent is extended or adjusted under 35 U.S.C. 154(b) by 133 days.

(21) Appl. No.: 15/090,615

(22) Filed: Apr. 4, 2016

(65) Prior Publication Data

US 2017/0055737 A1 Mar. 2, 2017

Related U.S. Application Data

(60) Provisional application No. 62/178,213, filed on Apr. 3, 2015.

(51) Int. Cl.
*A47G 9/10* (2006.01)
*A47G 9/02* (2006.01)

(52) U.S. Cl.
CPC ..... *A47G 9/10* (2013.01); *A47G 9/0253* (2013.01); *A47G 2009/1018* (2013.01)

(58) Field of Classification Search
CPC ..... A47G 9/10
USPC ..... 5/636–640, 645, 652.1, 659, 652
See application file for complete search history.

(56) References Cited

U.S. PATENT DOCUMENTS 3,992,733 A * 11/1976 Racine ..... A47C 27/14 5/652
2007/0044239 A1* 3/2007 Leifermann ..... A47G 9/1081 5/636
2008/0235877 A1* 10/2008 Murray ..... A47G 9/10 5/640

* cited by examiner

*Primary Examiner* — Fredrick C Conley
(74) *Attorney, Agent, or Firm* — HH Bennett, LLC; Harold H. Bennett, II

(57) ABSTRACT

A reversible pillow includes a plurality of cut foam pieces enclosed between a first external fabric layer of the pillow and an internal mesh layer. A second external fabric layer is coupled to the first external fabric layer and the internal mesh layer. An aperture opening into a space between the second external fabric layer and the internal mesh layer provides access into the interior of the pillow, and a flap closure extends over the aperture. To shift the pillow from a normal-use state, in which the mesh layer is between the first and second external fabric layers, to a wash-ready state in which the first external fabric layer is positioned between the second external fabric layer and the mesh layer, a user reaches through the aperture and pulls the pillow inside out.

20 Claims, 19 Drawing Sheets

WASHABLE PILLOW WITH MULTIPLE CASES AND REVERSIBLE CORE

CROSS-REFERENCE TO RELATED APPLICATIONS

This application claims the benefit under 35 U.S.C. 119(e) of U.S. Provisional Patent Application No. 62/178,213, filed on Apr. 3, 2015.

TECHNICAL FIELD

The present disclosure relates generally to pillows and more particularly, but not exclusively, to pillows that can be turned inside out to expose a filling material for much quicker, thorough and easier washing and drying.

BACKGROUND

Today, people use many different types of pillows to try and get a good night's sleep. These various types of pillows employ different materials, textures, and comfort levels to account for variations in what people prefer in a pillow. But nearly all pillows have one thing in common: microorganism growth and allergen accumulation.

The hospitality industry of hotels and motels is beginning to cater to this real problem. It has moved toward pillows with down and feather fills, as alternatives, and many are not only washing the pillow covers, but washing the pillow itself. Herein lies a particular problem: pillows are thick and difficult to wash. Even one or two hotel pillows can fill a commercial washer and dryer, and take hours to dry, while only really washing the outside of the pillowcase. It is difficult for air and water to get through the pillowcase fabric and thick cotton ball-types of fillings. Even feathers and down tend to clump together when wet, resulting in similar difficulties. Many pillows cannot even be washed.

Many pillow makers have concentrated on comfort as a leading factor in developing pillows, rather than managing microorganism growth. Thorough cleaning is an effective technique for managing microorganisms in pillows, but because current pillow designs are often difficult to clean, this results in un-effective microorganism management. Some pillow designs make claims of being washable in conventional washing machines. Unfortunately, most of these pillows suffer from similar problems, such as: I) an inability to effectively permit hot water and air to penetrate to the core of the pillow in such a manner as to kill the bacteria and molds, without sacrificing the comfort and quality that is essential to sleep; 2) an inability to be washed and dried quickly enough to finish in one cycle; 3) a requirement that a pillow be balanced in a washing machine, such as by the use of a second pillow or other items (e.g., tennis balls), to balance the pillow and/or beat the pillow clean; and 4) a failure to fully dry the center of the pillow, even in multiple cycles in a dryer.

Often, pillows with regular polyester, feather, and/or down fill are difficult to dry, let alone wash. Similarly, pillow cases made out of higher density materials (e.g., 300, 200 or 100 count cotton, or synthetic, blended, or other tightly woven materials) typically hamper the penetration of water and air to the center of the pillow.

Some companies have turned to chemicals along with various other materials to try and solve some of the problems with washing pillows. However, these chemicals/materials have a tendency to settle and make the pillow uncomfortable. Also, some companies have tried to make pillows with foam materials and/or washable cases. But many times the foam can only be spot cleaned or dry cleaned. Yet other products that are made of plastics can be brittle, and often do not have the right combination of cushion, conformability, shape adjustability, and high quality cleaning capability. Previously, the predominant outlook of pillow cleaning has been that pillows can only be cleaned on the surface and not deep inside.

The inventor has recognized that what is needed is a pillow which offers superior cushioning, form fit, overall shape and support, is easy to thoroughly clean, and enables the user to reach inside the core to really feel that it is dry. Thus, it is with respect to these and other considerations that the invention has been made.

BRIEF DESCRIPTION OF THE DRAWINGS

Non-limiting and non-exhaustive embodiments are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein:

FIG. 18 shows a schematic perspective view of an inner shell case partially removed from an outer shell case in accordance with at least one of the various embodiments;

DETAILED DESCRIPTION

Figure 1:
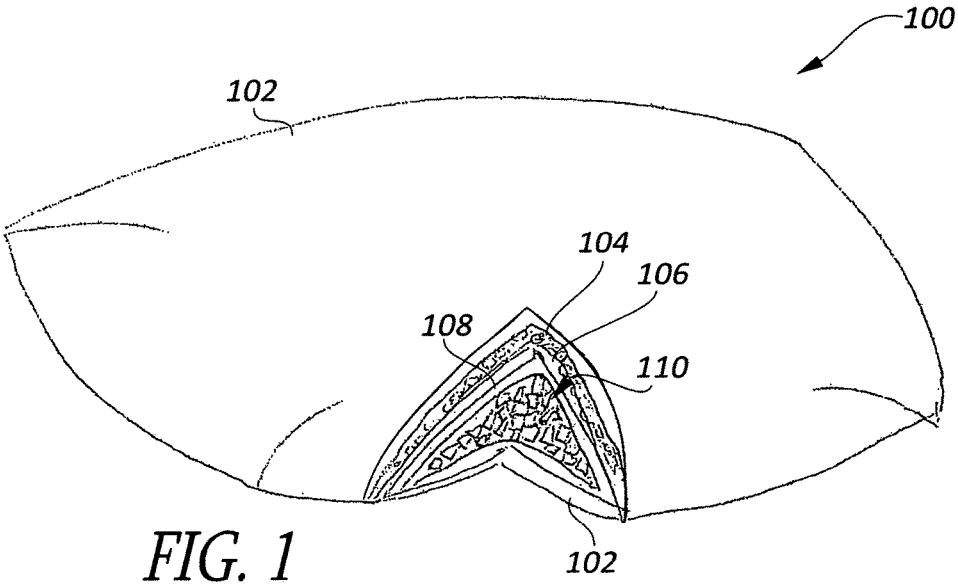
FIG. 1 shows a schematic perspective view with a cutout of a pillow in accordance with at least one of the various embodiments.

Various embodiments are described more fully hereinafter with reference to the accompanying drawings, which form a part hereof, and which show, by way of illustration, specific aspects and embodiments by which the invention may be practiced. These embodiments are described in sufficient detail to enable those skilled in the art to practice the disclosed principles of the invention. It will be apparent, however, to one skilled in the art that the various embodiments may be practiced without some of these specific details or with additional details not shown. Embodiments of the invention may be produced or practiced in many different forms, and should not be construed as being limited to those embodiments set forth herein; rather, these embodiments are provided so that this disclosure will be thorough and complete, and will fully convey the scope of the invention to those skilled in the art. Among other things, the various embodiments may include methods, systems, or apparatuses.

Throughout the specification and claims, the following terms take the meanings explicitly associated herein, unless the context clearly dictates otherwise. The term "herein" refers to the specification, claims, and drawings associated with the current application. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention. The following detailed description is does not limit the scope of the invention, which is instead defined only by the appended claims, along with the full scope of legal equivalents to which such claims are entitled.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Brief Overview

The following briefly describes embodiments of the invention in order to provide a basic understanding of some aspects of the invention. This brief overview is not intended as an extensive description. It is not intended to identify key or critical elements, or to delineate or otherwise narrow the scope. Its purpose is merely to present some concepts in a simplified form as a prelude to the more detailed description that is presented later.

Briefly stated, various embodiments are directed to a pillow with a removable or reversible core that includes a plurality of individual foam pieces of various or similar size. The pillow may include an outer shell case and/or an outer shell case and an inner shell case (i.e., a removable core). The outer shell case can include top and bottom external layers of a same material or of different fabric materials. The outer shell case may be made of a plurality of layers, including a backing layer positioned between an external layer and an internal layer. In some embodiments, the internal layer may comprise an open mesh material and the backing layer may comprise a foam material. The inner shell case may be removably inserted into the outer shell case and the inner shell case may comprise another open mesh material. In some embodiments, the inner shell case and an internal layer of the outer shell case can be made of the same material (e.g., nylon or polyester). Also, a plurality of foam pieces may be disposed in the inner shell case. In some embodiments, the foam pieces may be made of same or different foam as the backing layer of the outer shell case. In various embodiments, the plurality of foam pieces may be sharply cut polyurethane foam. The foam pieces may be of similar of different sizes and may be of any similar or different shapes (e.g., rectangular/bar-shaped, square/cubic, elongated, triangular/pyramidal, parallelepiped, spherical, half-hemispheres, trapezoidal, tubes/cylindrical, conical, any other regular or non-regular three-dimensional shapes, or any combination thereof, and may be solid, hollow, perforated, or any combination thereof.).

In some embodiments, the outer shell case may include a first sleeve, a second sleeve and a plurality of inner shell cases may be inserted into the outer shell case. In other embodiments, the outer shell case is singularly connected to the pillow core with a single opening at the end. The shell case may include only top and bottom external layers, or may also include various additional layers, such as, e.g., foam backing layers. In one embodiment, the shell case has a single foam backing layer on the inside of a top external layer and a plurality of foam pieces of various or similar sizes between the foam backing and a mesh netting layer. The embodiment has a single fabric layer—e.g., the bottom external layer—covering the mesh netting directly, with the single opening extending into a space between the single fabric layer and the mesh netting. The opening is covered by a fabric flap, which can be of the same material as the shell or of a different fabric, for the purpose of comfort to the skin. When the flap is reversed the core is revealed, with the mesh layer covering and containing the plurality of foam pieces. The pillow case can then be reversed by the user reaching into the core, grabbing onto the mesh netting, and pulling the core from the end and out the opening. Once reversed, the various foam pieces will be exposed (within the mesh netting) for the purpose of washing and drying quickly. The exposed foam pieces are no longer blocked by a high thread count fabric and water and air can move through without the usual obstructions that occur with fabrics with medium or high thread counts.

In various embodiments, a further protective storage case may be provided, while an inner case or cases inserted into the the protective case may be of complete pillows that employ embodiments described herein—e.g., an integrated pillow with a reversible core or a separate inner case that itself includes an outer shell case (with two or more layers) and a removable inner shell case (that includes a plurality of foam pieces).

General Description

FIG. 1 shows a schematic perspective cutaway view with a of a pillow 100 in accordance with an embodiment. Pillow 100 includes an outer shell case and an inner shell case 108. The outer shell case can include an external layer 102, a backing layer 104, and an internal layer 106. Inner shell case 108 includes a plurality of foam pieces 110 disposed therein.

Figure 2:
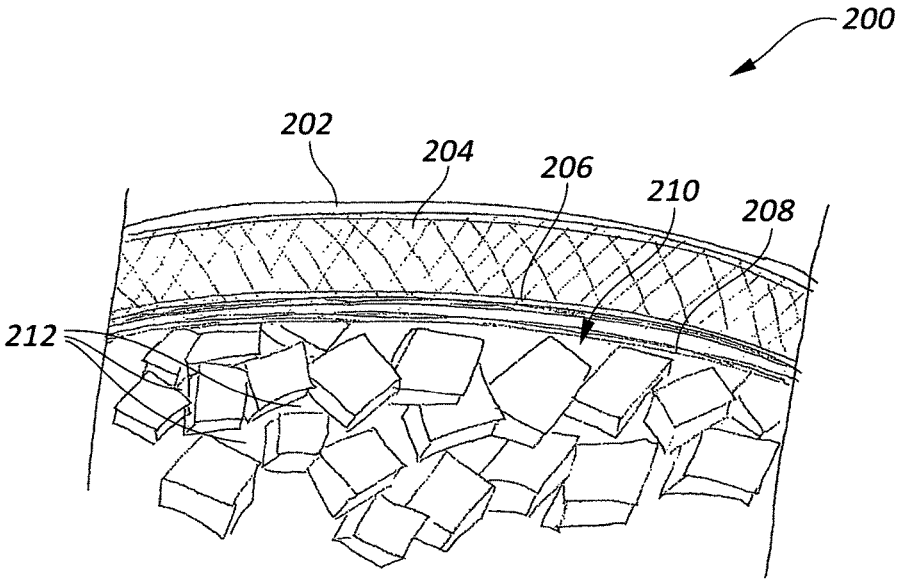
FIG. 2 shows a schematic cross-sectional view of a pillow in accordance with at least one of the various embodiments.

FIG. 2 shows a schematic cross-sectional view of of a pillow 200 in accordance with an embodiment. Pillow 200 is similar to the pillow 100 of FIG. 1, and may include an outer shell case (or casing) and an inner shell case 208. In some embodiments, these casings may also be referred to as an exterior shell casing and an interior shell casing, respectively.

The outer shell case can include multiple layers, such as an external layer 202, a backing layer 204, and an internal layer 206. Inner shell case 208 may include a plurality of foam pieces 210 disposed therein, with open spaces 212 between the foam pieces.

In some embodiments, the external layer 202 of the outer shell case is made of nylon, polyester, or other open mesh material. External layer 202 may be sewn together with the backing layer 204 and/or the internal layer 206, such that the backing layer 204 is between the external layer 202 and the internal layer 206, with the internal layer 206 disposed on the inside of the outer shell case and positioned between backing layer 204 of the outer shell case and inner shell case 208.

In various embodiments, the external layer 202 is made of material that includes perforations on the exterior of the case that are visible to the human eye. Dimensions of these perforations may vary from approximately 0.0254 millimeters to approximately 5.08 millimeters (or approximately 0.001 inches to 0.2 inches) on a side, depending upon the material of the external layer 202 and/or equipment used to make the material. In various embodiments, the perforations may have a patterned appearance. The patterned perforations may include round holes, square holes, or other shapes. In one embodiment, the holes in the patterned perforations are consistent with one another. In some embodiments, these perforations may be configured to increase water and air penetration into the backing layer 204 and/or into the inner shell case 208, which can increase the effectiveness of washing/drying cycles of a washing machine or dryer.

According to an embodiment, the backing layer 204 may be of similar thickness and/or similar density throughout. In some embodiments, the backing layer 204 may be a cushion made of polyurethane foam. In some embodiments, the foam used as backing layer 204 may be open cell or completely open cell without membranes—i.e., reticulated foam. Backing layer 204 may have a thickness between approximately 3.175 millimeters and 25.4 millimeters (or approximately 0.125 and 1.0 Inches), but thinner or thicker foams or cushion materials may be used. In some embodiments, the backing layer 204 may be made of a same or similar foam and/or same or similar thickness as foam pieces 210 included inside the inner shell case 208, as described herein.

In some embodiments, the internal layer 206 of the outer shell case can be made of a mesh material with holes ranging from approximately 0.254 millimeters to 6.35 millimeters (or approximately 0.01 to 0.25 inches). This internal layer may be sewn (or otherwise attached) to the backing layer 204 and/or the external layer 202 such that the internal layer is inside of the outer shell case. This mesh can allow more thorough washing and drying of the foam backing layer. In some embodiments, the internal layer 206 may be made of the same material as inner shell case 208.

The outer shell case, and in particular, backing layer 204, may provide many advantages. For example, it may hide lumps caused by the plurality of foam pieces 210 inside inner shell case 208. Also, the outer shell case can help the inner shell case 208 maintain a selected degree of firmness. Another reason behind the outer shell case is aesthetic appeal. Many users appreciate and want an eye appealing look on their beds. If the outer shell case is too thin, or absent, lumps may be readily visible, which can be annoying to some users. Backing layer 204 can also aide in the equal distribution of foam pieces inside the inner shell case 208. In some situations, the outer shell case can act to balance or equalize the mesh filled inner shell case. Because foam typically contains static electricity, and is usually relatively jagged as viewed under a microscope, small separately dispersed pieces can be held in position better with a counter balance of a foam backing layer of the outer shell case than with a thin casing as used in most pillows.

Figure 7:
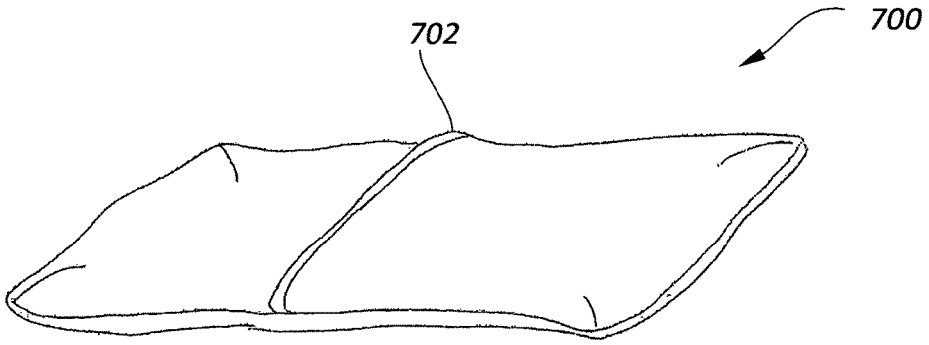
FIG. 7 shows a schematic perspective view of a pillow's outer shell case without the inner shell case in accordance with at least one of the various embodiments.
Figure 9:
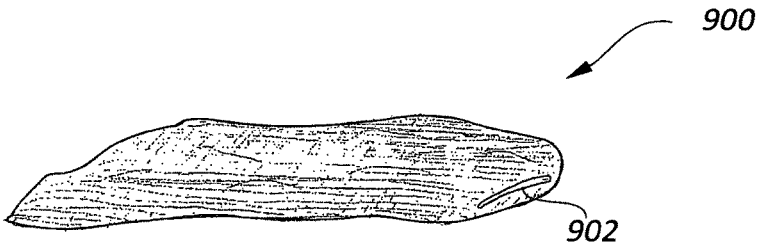
FIG. 9 shows a schematic perspective view of a pillow's inner shell case filled with foam pieces without the outer shell case in accordance with at least one of the various embodiments.

In some embodiments, the outer shell case may include an aperture extending across a width of the body of the pillow, which is further illustrated in FIGS. 7 and 9.

Inner shell case 208 may include a cavity that can hold a plurality of foam pieces 210 disposed inside inner shell case 208. In one embodiment, the inner shell case 208 may be stitched or otherwise closed in an arrangement that prevents foam pieces 210 from being removed from or falling out of the inner shell case 208. In other embodiments, the inner shell case 208 may include an access passage that can allow a user and/or manufacturer to add or remove foam pieces or so that the user can directly feel the foam pieces, to, e.g., determine dryness after washing. Such an access passage may include a zipper, buttons, Velcro, or other fastener, which is further illustrated below in conjunction with FIG. 9.

In various embodiments, inner shell case 208 may be made of a mesh material. Examples of such mesh material may include, for example, nylon, polyester, or similar material. According to an embodiment, the mesh material of the inner shell case includes a plurality of holes. These holes are typically much greater in size than the openings in the weave of most cotton sheets, but not large enough that foam pieces 210 can fall completely through the inner shell case 208. In some embodiments, the inner shell case 208 may be made of the same material that is used for the internal layer 206 of the outer shell case.

In some embodiments, the various components of the pillow may be made of, include, or be treated with hypoallergenic materials (e.g., to remove grasses or other pollens). In one such embodiment, the inner shell case and/or the outer shell case include hypoallergenic materials. Other embodiments include a hypoallergenic assembly of the casings and filling (e.g., the plurality of foam pieces). Similarly, some embodiments include a hypoallergenic assembly of casings, the foam backing (e.g., backing layer 204), and other pillow features not described herein.

According to an embodiment, the various components (e.g., materials/fabrics/foams) used to make the outer shell case, the inner shell case, and/or the foam pieces may be manufactured of and/or treated with various healthful products, such as, e.g., anti-bacterial, anti-mold, anti-allergen, or the like. In some embodiments, the various pillow components may be treated after they are made—e.g., coating them with a chemical, pesticide, or other compound-which may provide some of these healthful properties.

In further embodiments, the pillow components may be manufactured with chemicals and/or compounds such that the healthful properties are directly built in. However, other embodiments are not so limited and other methods and/or treatments may be utilized to provide additional healthful properties to the various pillow materials, fabrics, and/or foams.

As described herein, a plurality of foam pieces 210 is disbursed inside the inner shell case 208 of the pillow. The spaces 212 between the foam pieces 210 allow air to continually pass through the pillow, keeping the pillow cool and dry. Similarly, these spaces 212 can allow hot water to pass easily through the pillow and in essence enable thorough cleaning and/or scrubbing of the core of the pillow.

In some embodiments, the plurality of foam pieces 210 are made from various types of foam with various different properties, some of which are described in more detail below in conjunction with FIGS. 24 and 25. Similarly, various machines and/or processes may be employed to obtain foam pieces of a selected size and/or shape, in which one embodiment is described in more detail below in conjunction with FIG. 26A-26D.

According to an embodiment, the plurality of foam pieces 210 are formed or otherwise cut in similar shapes. According to other embodiments, the plurality of foam pieces are cut into different shapes. In various embodiments, the plurality of foam pieces 210 may be of various shapes, including regular and/or irregular shapes. For example, foam pieces 210 may be rectangular/bar-shaped, square/cubic, elongated, triangular/pyramidal, parallelepiped, spherical, half-hemispherical, trapezoidal, tubes/cylindrical, conical, or the like, or and any other regular or non-regular three-dimensional shapes, or any combination thereof. In various embodiments, the foam pieces may be solid, hollow, perforated, or the like, or any combination thereof.

In various embodiments, foam pieces 210 may be of similar sizes. In some embodiments, each of the plurality of foam pieces 210 may have an average thickness of approximately 5.08 millimeters to 76.2 millimeters (or approximately 0.2 to 3 inches). However, other embodiments are not so limited and other sizes/shapes may be employed. For example, in some embodiments, the plurality of foam pieces may be rectangular with lengths between approximately 5.08 millimeters to 76.2 millimeters (or approximately 0.2 inches to 3 inches). In other embodiments, the plurality of foam pieces may be square (or cubic), ranging in size between approximately 6.35 millimeters to 76.2 millimeters (or approximately 0.25 inches to 3 inches) in height. In yet other embodiments, the plurality of foam pieces may have an elongation percentage of 90 to 110 percent. According to further embodiments, other sizes and/or variances in size may also be employed. In one embodiment, the sizes of the plurality of foam pieces are selected such that they have similar group densities. In an embodiment, the size of foam pieces 210 are selected so as to produce an equal dispersion of density. For example, in some embodiments, three different sizes (and/or shapes) of foam pieces are used such that ⅓ of the plurality of foam pieces are of a first size, ⅓ of the plurality of foam pieces are of a second size, and ⅓ of the plurality of foam pieces are of a third size (although other numbers of different sizes and/or shapes may be used, in various other proportions).

The size and shapes of the foam pieces 210 may be selected by engineering judgment such that the plurality of foam pieces may be similar enough to randomly work together as pillow fill to result in a substantially similar density throughout the pillow and to not create a lopsided pillow, while being large enough to be contained by inner shell case 208. In some embodiments, the size of the foam pieces may be selected for their average size, and the selected group may adhere to a selected standard deviation of size. In one such embodiment, a standard deviation of sizes for each foam size group is selected to achieve a beneficial interrelationship between the foam pieces. In some embodiments, the foam pieces are selected such that when combined into groups, a group of 100 pieces (or other suitable number of pieces) is of a density that is similar to the density of a different group of 100 pieces, even though a size of each foam piece can vary from approximately 5.08 millimeters to approximately 76.2 millimeters (or approximately 0.2 inches to approximately 3 inches). In one embodiment, one size may be used for maximum comfort and dispersion throughout the pillow. In any event, embodiments are not limited to foam pieces of a particular size or of a particular average size, and other sizes of foam pieces than what is described herein may be used within the present scope. Additionally, it is envisaged that various sizes and/or shapes of the plurality of foam pieces may be employed in various different ratios for different embodiments.

In various embodiments, the plurality of foam pieces 210 are die cut in any of a variety of solid shapes. The foam pieces 210 are preferably not frayed or shredded, so that small particles do not escape through the mesh material of the inner shell case. For example, in an embodiment, the plurality of foam pieces are sharply cut to minimize foam crumbs inside the pillow. In other embodiments, the plurality of foam pieces may be precision cut so as to leave zero (or almost zero) flaking of foam. In yet other embodiments, the plurality of foam pieces may be formed such that they leave zero residual foam (or predominantly zero) pieces that can escape through the mesh of the inner shell case. It should be recognized that other sizes and/or shapes of the foam pieces may vary depending on the size and/or shape of the pillow; or a desired give, compressibility, or softness of a the pillow; etc.

Figure 3:
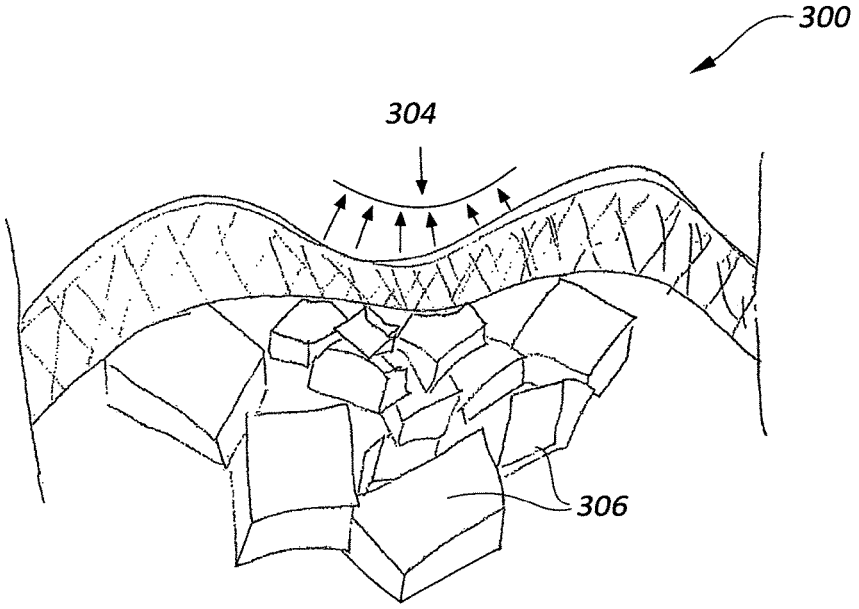
FIG. 3 shows a schematic cross-sectional view of a pillow with a weight of a head or similar) in accordance with at least one of the various embodiments.

FIG. 3 shows a schematic cross-sectional view of a pillow with a weight of a head or other object in accordance with at least one of the various embodiments. Pillow 300 is similar in structure to the pillow 200 of FIG. 2. Force 304 represents a head or other object resting on the pillow 300, which can compress at least a portion of foam pieces 306 (which are structural similar to the foam pieces 210 of FIG. 2).

Figure 4:
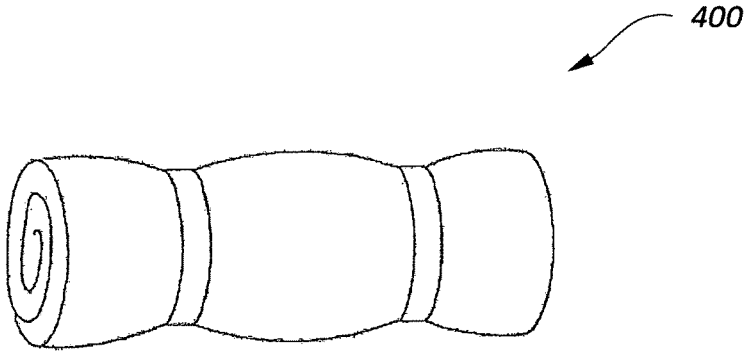
FIG. 4 shows a schematic perspective view of a pillow rolled in accordance with at least one of the various embodiments.

FIG. 4 shows a schematic perspective view of a pillow rolled in accordance with at least one of the various embodiments. Pillow 400 is similar in structure to the pillow 200 of FIG. 2, but rolled up to illustrated the compressibility of pillow 400.

Figure 5:
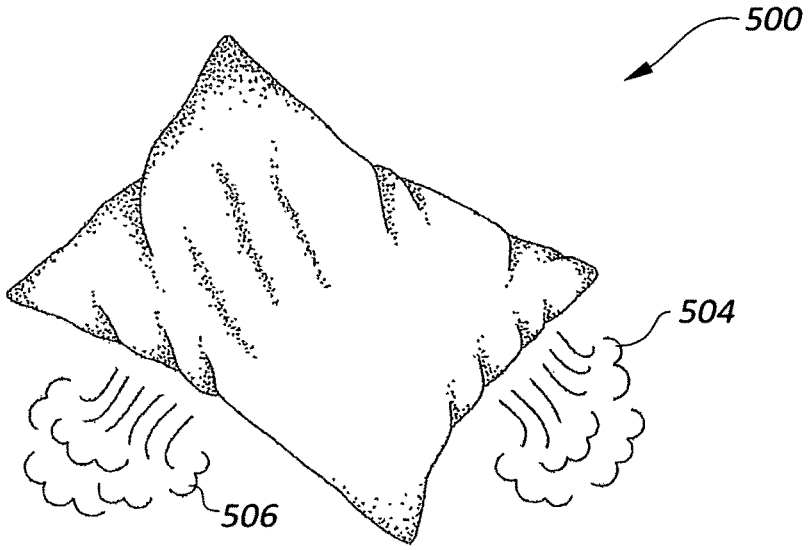
FIG. 5 shows a schematic top view of a pillow with air passing through it in accordance with at least one of the various embodiments.

FIG. 5 shows a schematic top view of a pillow with air passing through it in accordance with at least one of the various embodiments. Pillow 500 is similar in structure to the pillow 200 of FIG. 2. As illustrated and described herein, air may flow through pillow 500, which is indicated by air 504 and 506 exiting the pillow.

Figure 6:
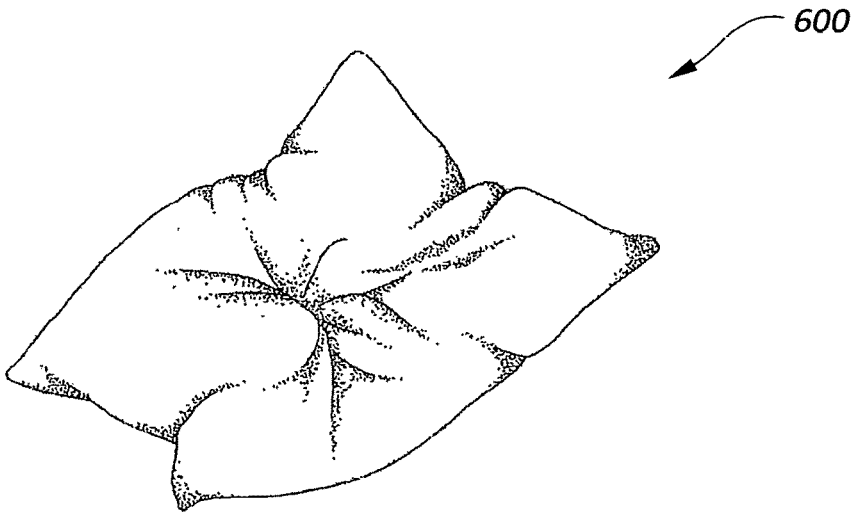
FIG. 6 shows a schematic top view of a pillow in a cushioned position for the flexibility in accordance with at least one of the various embodiments.

FIG. 6 shows a schematic top view of a pillow in a cushioned position for the flexibility in accordance with at least one of the various embodiments. Pillow 600 is similar in structure to the pillow 200 of FIG. 2.

FIG. 7 shows a schematic perspective view of a pillow's outer shell case without the inner shell case in accordance with at least one of the various embodiments. Outer shell case 700 is similar in structure to the outer shell case described in FIG. 2. Outer shell case 700 may include an aperture 702.

In some embodiments, the aperture 702 enables the removal of the inner shell case (e.g., inner shell case 208 of FIG. 2 and/or inner shell case 900 of FIG. 9) from outer shell case 700, so that both cases can be washed and/or dried at the same time (e.g., washed in the same machine at the same time). In other embodiments, aperture 702 can provide access to the inner shell case so that foam pieces (e.g., foam pieces 210 of FIG. 2) can be added or removed from the inner shell case. In some embodiments, the aperture includes a zipper, Velcro, buttons, or the like. Other, embodiments are not so limited, but rather, in various embodiments, no zipper is utilized. One reason for omitting zippered openings is to prevent tears. Sometimes, tears can occur when a case that includes a zipper is repeatedly opened and closed for repeated washings. Further, the absence of a zipper can enhance the feel of the pillow, because an elongated zipper across the body of the pillow can be uncomfortable to some users.

Figure 8:
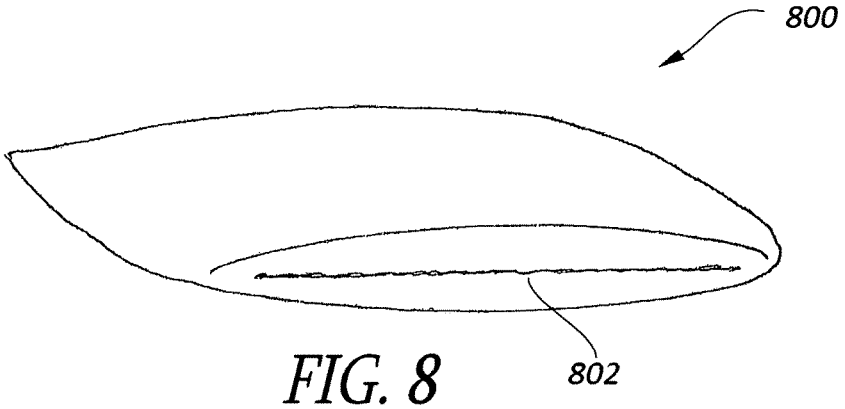
FIG. 8 shows a schematic perspective view of a pillow's outer shell case in accordance with at least one of the various embodiments.

FIG. 8 shows a schematic perspective view of an alternative embodiment of a pillow's outer shell case, in accordance with an embodiment. Outer shell case 800 is similar in structure to the outer shell case described in FIG. 2. Outer shell case 800 may include aperture 802.

In at least one of the various embodiments, aperture 802 may be a zipper that is positioned longitudinally along at least one edge of pillow 800. In some embodiments, aperture 802 can allow the removal of the inner shell case (e.g., inner shell case 208 of FIG. 2 and/or inner shell case 900 of FIG. 9) from outer shell case 800, so that both cases can be washed and/or dried at the same time (e.g., washed in the same machine at the same time). In other embodiments, the aperture 802 can provide access to the inner shell case so that foam pieces (e.g., foam pieces 210 of FIG. 2) can be added or removed from the inner shell case. In some embodiments, the aperture can include a zipper, Velcro, buttons, or the like.

In some embodiments, the outer shell case 800 may include a top and bottom face. Both the top and bottom face may each comprise an external layer (such as external layer 202 of FIG. 2), a foam backing (such as backing layer 204 of FIG. 2), and an internal layer (such as internal layer 206 of FIG. 2). In some embodiments, the internal layer and the external layer may comprise a same material. In other embodiments, the internal layer may comprise a different material, such as a mesh material.

FIG. 9 shows a schematic perspective view of a pillow's inner shell case filled with foam pieces, with the outer shell case omitted, in accordance with at least one of the various embodiments. Inner shell case 900 is similar in structure to the inner shell case 208 of FIG. 2. In some embodiments, inner shell case 900 may include an aperture 902, which may have a zipper or other access mechanism to the inside of inner shell case 900. In various embodiments, aperture 902 may be positioned at an end of inner shell case 900 so as to not interfere with use of the pillow.

Figure 10:
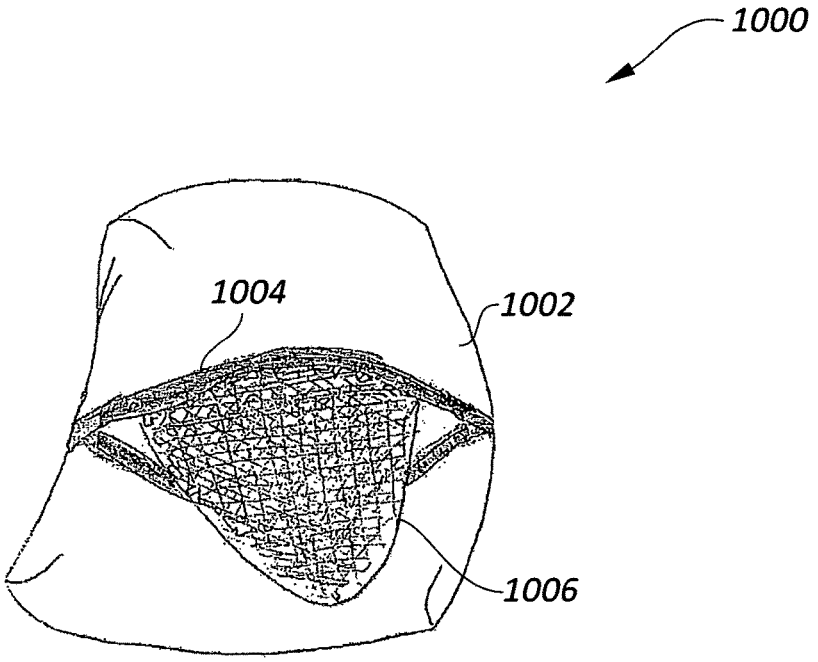
FIG. 10 shows a schematic top view of a pillow with an inner shell case partially removed from an outer shell case in accordance with at least one of the various embodiments.

Inner shell case 900 may be substantially the same shape and size as the outer shell case (e.g., outer shell case 700 of FIG. 7 or outer shell case 800 of FIG. 8) but that inner shell case 900 can fit within the outer shell case. In at least one of various embodiments, inner shell case 700 may be referred to as a removable core of the pillow, which is illustrated in FIG. 10. The inner core may be constructed to include an open fabric and various loose pieces of foam material such that it can be easily washed and dried, as described herein.

FIG. 10 shows a schematic top view of a pillow with an inner shell case partially removed from an outer shell case in accordance with at least one of the various embodiments. Pillow 1000 is similar in structure to the pillow 200 of FIG. 2. As illustrated, the inner shell case 1006 may be partially removed from outer shell case 1002 through aperture 1004. In some embodiments, inner shell case 1006 may be completely removed from outer shell case 1002 and both may be washed independently, apart, and/or separately from one another.

Figure 11:
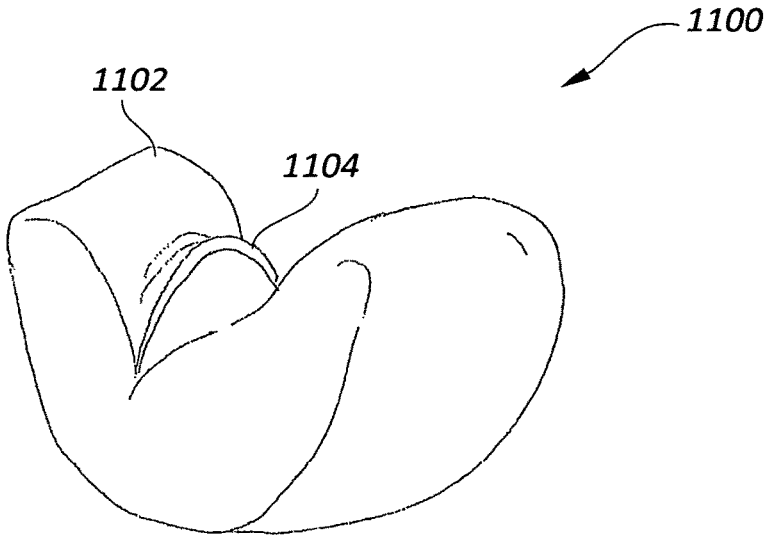
FIG. 11 shows a schematic perspective view of a pillow in a flexed position in accordance with at least one of the various embodiments.

FIG. 11 shows a schematic perspective view of a pillow in a flexed position in accordance with at least one of the various embodiments. Pillow 1100 is similar in structure to the pillow 200 of FIG. 2. As illustrated, aperture 1104 may flex with outer shell case 1102.

Figure 12A:
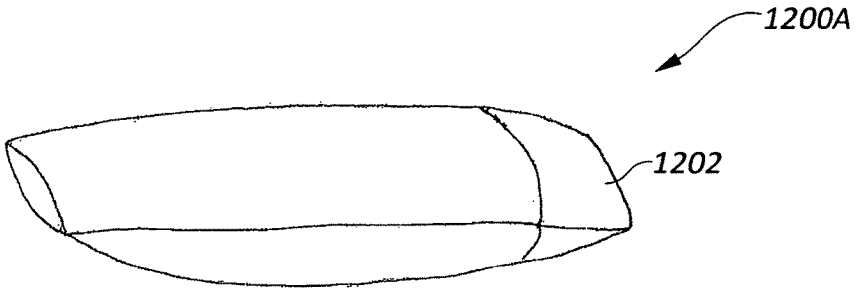
FIGS. 12A-12C show schematic perspective views of a pillow with an outer shell case with a folding flap in accordance with at least one of the various embodiments.
Figure 12B:
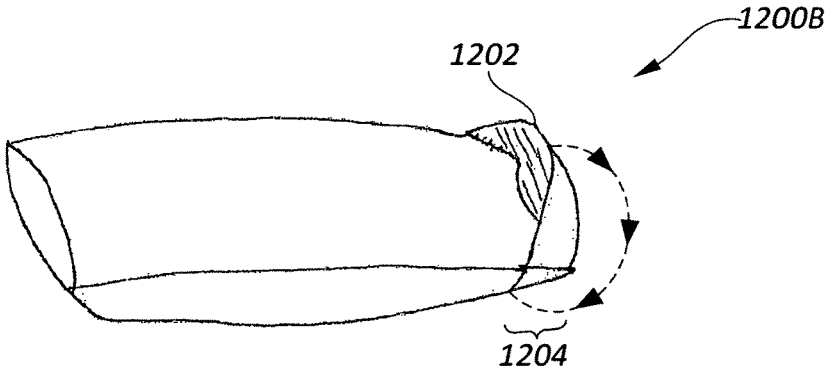
Figure 12C:
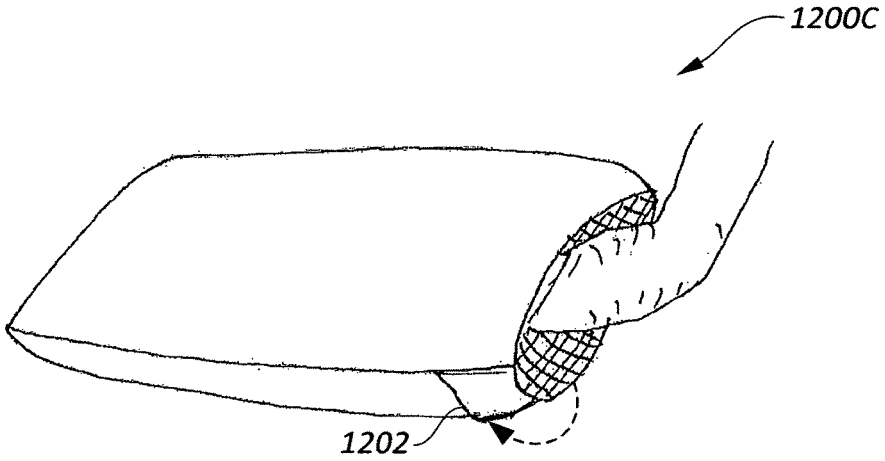

FIGS. 12A-12C show schematic perspective views of a pillow with an outer shell case with a folding flap, in accordance with an embodiments. In various embodiments, the outer shell case 1200 (illustrated by outer shell case 1200A, 1200B, and 1200C) includes a flap 1202. Flap 1202 is near one end of outer shell case 1200. Flap 1202, and is stitched longitudinally along opposing sides of the case such that the flap overlaps the outer shell case by length 1204. Length 1204 may vary but is preferably at least long enough so as to prevent an inner shell case from sliding out of the outer shell case without assistance by a user. Flap 1202 may fold over the end of the outer shell case to open, as depicted by the dashed arrow in FIG. 12B. Once the flap is open, a user may remove the inner shell case, as illustrated by FIG. 12C.

Figure 13:
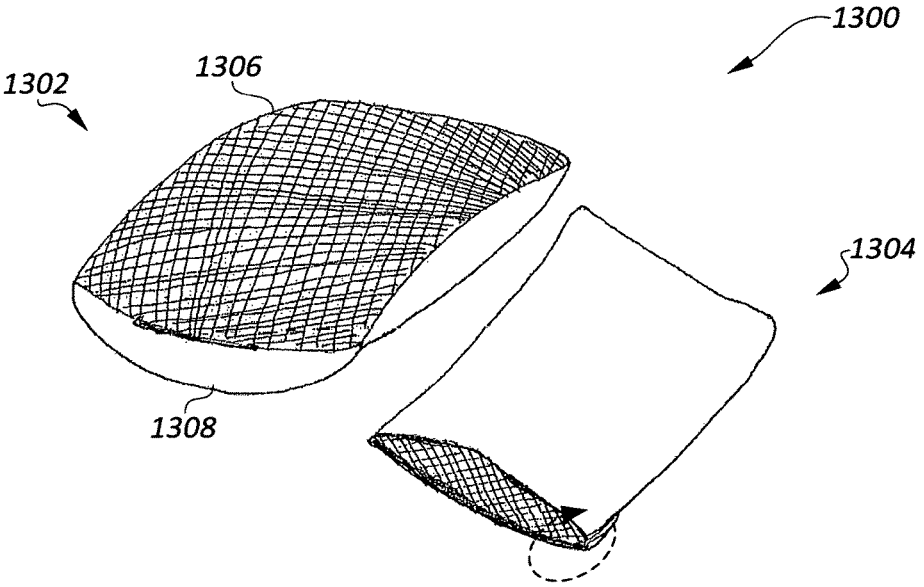
FIG. 13 shows a schematic perspective view of an inner shell case and an outer shell case in accordance with at least one of the various embodiments.

FIG. 13 shows a schematic perspective view of an inner shell case and an outer shell case in accordance with another embodiment. Pillow 1300 includes an inner shell case 1302 (also referred to as the pillow core) and an outer shell case 1304. In some embodiments, inner shell case 1302 may include a mesh face 1306 opposite and opposing a non-mesh face 1308. In some embodiments, the mesh face 1306 is a mesh material, as described herein, which may include, but is not limited to, nylon, polyester, or similar material. The mesh material includes a plurality of holes to permit water and air to flow through the mesh face 1306 for efficient washing and drying of the pillow core. These holes are typically much greater in size than the openings in the weave of most cotton sheets, but are not so large that foam pieces can fall completely through. In various embodiments, non-mesh face 1308 may be of nylon, polyester, water resistant fabric, etc. As described herein, inner shell case 1302 may include a plurality of loose foam pieces. In one embodiment, the non-mesh face 1308 also includes a foam backing on the interior side of the face.

Outer shell case 1304 is similar in structure to the outer shell case described in FIG. 2, and may include an external layer (e.g., nylon, polyester, water resistant fabric, or the like), an internal layer (e.g., an open mesh fabric), and a foam sheet disposed between the internal and external layer, as described herein. According to an embodiment, the outer shell case 1304 includes two internal faces or layers, one of which is an open mesh material, and the other of which is a non-open mesh material (e.g., cotton or polyester fabric, or another suitable material). The two internal faces are opposite and facing each other on the interior of the outer shell case 1304. In at least one of various embodiments, the internal face with the non-open mesh material may be backed with a foam layer, but the internal face with the open mesh material may not have a foam backing layer.

In various embodiments, inner shell case 1302 is inserted into the outer shell case 1304, such that the mesh face 1306 is positioned face-to-face with a mesh internal face of outer shell case 1304 (both of these mesh faces may comprise the same material or different materials). This arrangement may enable a foam backing of outer shell case 1304 to be on an opposite side of the pillow from a foam backing of the inner shell 1302 (as described below with reference to FIG. 16), so that regardless of which side of the pillow is facing up, a user will feel a foam backing layer rather than just the foam pieces inside the inner shell case.

Figure 14:
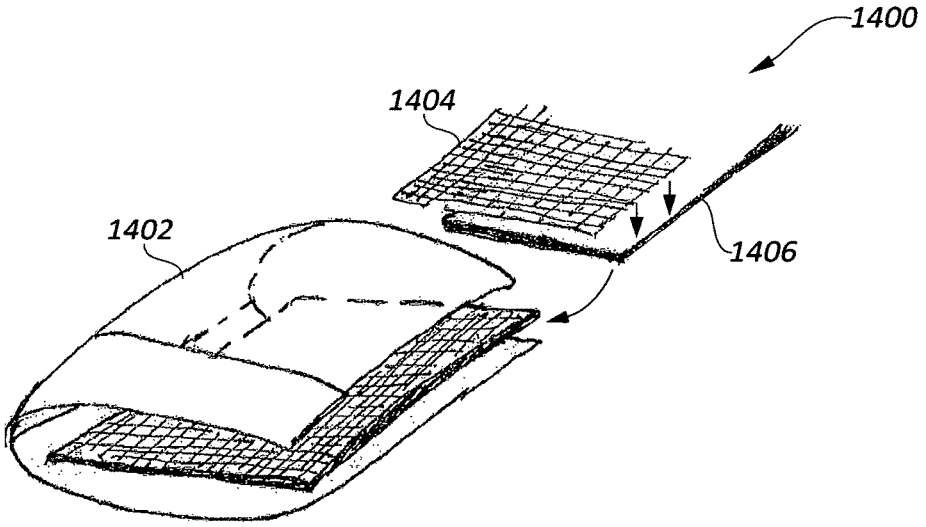
FIG. 14 shows a schematic partial exploded view of an outer shell case in accordance with at least one of the various embodiments.

FIG. 14 shows a schematic partial exploded view of an outer shell case 1400, in accordance with one of the various embodiments. Outer shell case 1400 is similar in structure to the outer shell case 1304 of FIG. 13. In the embodiment shown, an external layer 1402 forms the outer layer on both sides of the outer shell case 1400. As illustrated, a mesh internal layer 1404 is attached to a backing layer 1406 (e.g., these layers may be stitched together). In some embodiments, the mesh internal layer 1404 is similar in structure to the internal layer 206 of FIG. 2 and the backing layer 1406 is similar in structure to the backing layer 204 of FIG. 2. The combined layers 1404 and 1406 are sewn onto the external layer 1402 on one side (or face) of the outer shell case 1400, which enables an inner shell case (or core) to slip into outer shell case 1400. In yet other embodiments, the combined layer 1404 and layer 1406 extends across the entire length of the external layer 1402, on both sides of the outer shell case 1400. In some embodiments, the external layer 1402 is similar in structure to the external layer 202 of FIG. 2.

Figure 15:
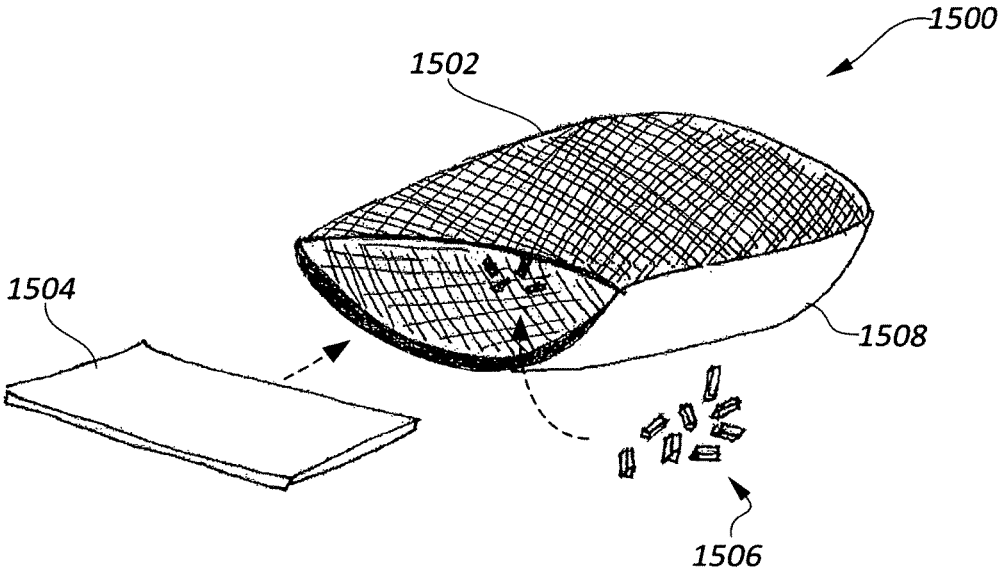
FIG. 15 shows a schematic cut-away view of an inner shell case in accordance with at least one of the various embodiments.

FIG. 15 shows a schematic cut-away view of an inner shell case in accordance with an embodiment. Inner shell case 1500 includes a mesh case 1502, a foam backing layer (illustrated by foam sheet 1504), a non-mesh layer 1508, and a plurality of foam pieces 1506. In some embodiments, the foam sheet 1504 is attached to the non-mesh layer 1508, and the combination is affixed (e.g., sewn) to one face of the mesh case 1502.

Figure 16:
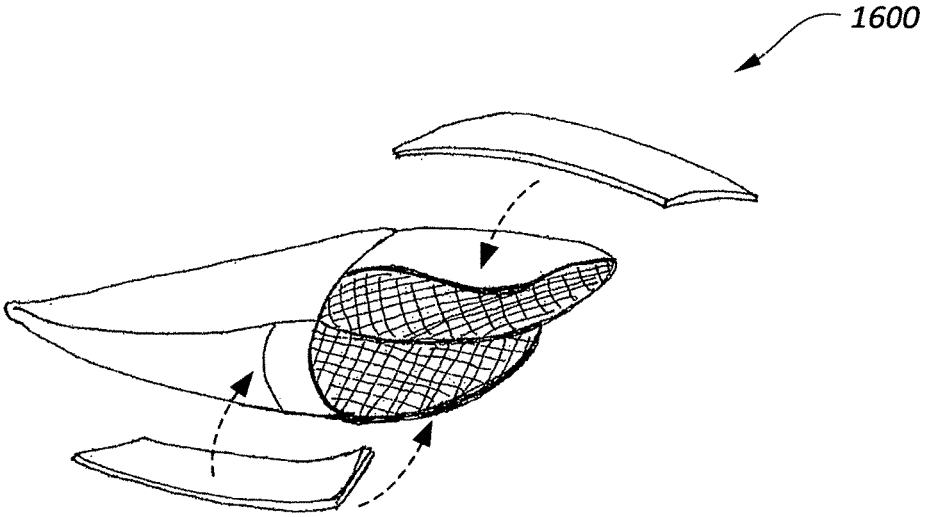

FIG. 16 shows a schematic perspective view of an inner shell case partially removed from an outer shell case in accordance with an embodiment. In various embodiments, pillow 1600 includes an inner shell case and an outer shell case (as described herein), where each case includes a foam backing layer affixed to a single face of a corresponding case, such that the foam backing layers are affixed to opposing faces as illustrated in the figure.

Figure 17A:
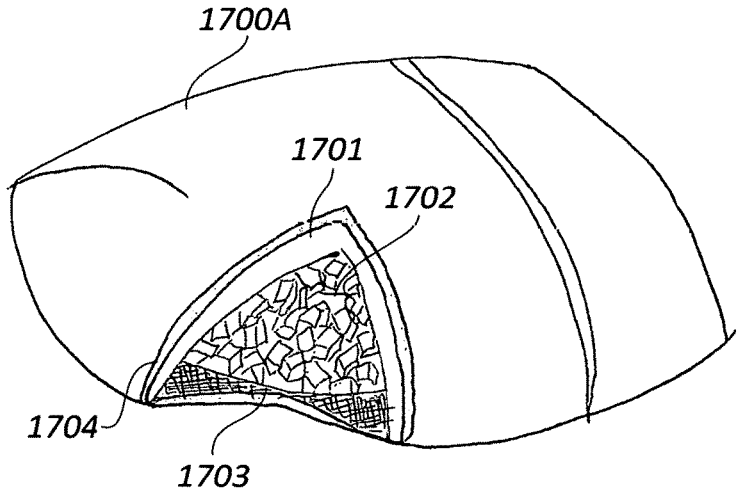
FIG. 17A shows a schematic perspective view with a cutout of a reversible pillow in accordance with at least one of the various embodiments.
Figure 17B:
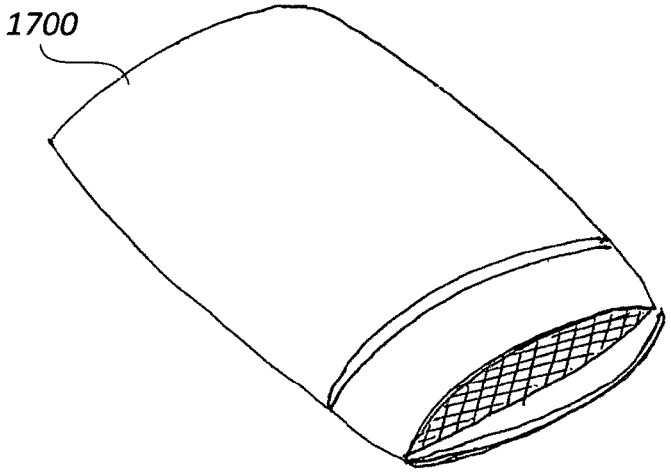
FIG. 17B shows a schematic top view of a pillow with the open flap and an inner shell case partially exposed from an outer shell case in accordance with at least one of the various embodiments.

FIGS. 17A-17B show respective schematic perspective cutaway views of a reversible pillow in accordance with an embodiment. Pillow 1700A includes an outer shell case and an inner shell case 1703. The outer shell case includes an external layer 1704. The inner shell case 1703 includes a plurality of foam pieces 1702 disposed therein. The pillow 1700 is similar in structure to the pillow 200 of FIG. 2, but in a one-part reversible pillow rather than in two parts, as described in more detail below with reference to FIGS. 18A-18E.

The outer shell case, and in particular, the backing layer 1701, may provide many advantages. For example, it may hide lumps caused by the plurality of foam pieces 1702 inside the inner shell case 1700A. Another reason behind the outer shell case is aesthetic appeal. Many users appreciate and want an eye appealing look on their beds. If the outer shell case is too thin, or not present at all, the lumps may be visible, which can be annoying to some users. Backing layer 1701 can also aide in the equal dispersion of foam pieces inside the inner mesh case 1703. In some situations, the outer shell case can act as a balancer or equalizer to the mesh filled inner shell case. Because foam typically contains static electricity, and is usually relatively jagged, as viewed under a microscope, small separately dispersed pieces can be held in position better by the foam backing layer 1701 of the outer shell case than by a thin casing as used in most pillows.

FIGS. 18A-18E shows various schematic perspective views of a reversible pillow with an integrated core, in accordance with one embodiment. In some embodiments, the pillow 1800 is similar ill structure to the pillow 1700 of FIGS. 17A-17B.

Figure 18A:
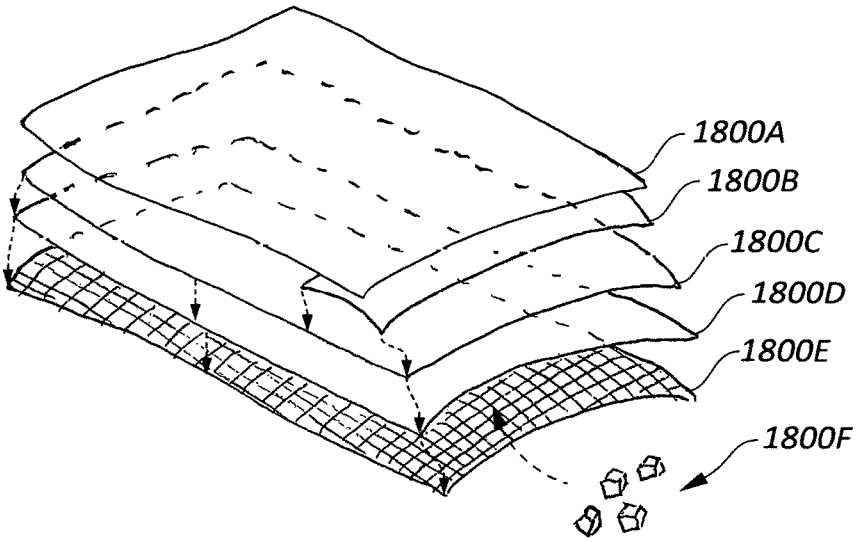
FIG. 18A shows a schematic back-perspective view of the layers of fabric for the reversible pillow in accordance with at least one of the various embodiments.
Figure 18B:
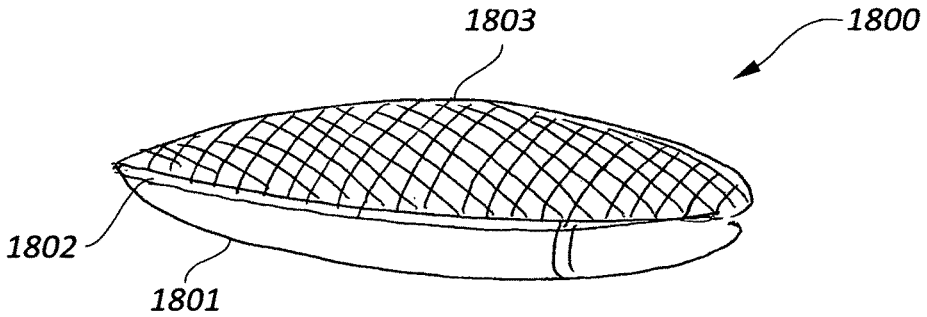
FIG. 18B shows a schematic perspective view of a reversible pillow after it is turned inside out to expose the filling in accordance with at least one of the various embodiments.

FIG. 18A is an exploded view of the reversible pillow 1800, showing layers 1800A-E of the pillow, as they are constructed, according to an embodiment. In typical fashion, the pillow 1800 is constructed in reverse, then turned right-side-out, to present a clean and neat appearance. The layers include an external bottom layer 1800A, a reversible flap 1800B, an external top layer 1800C, a foam backing layer 1800D, and a mesh fabric layer 1800E, which holds the various foam pieces 1800F between this and the foam backing layer 1800D.

The external bottom layer 1800A, reversible flap 1800B, and external top layer 1800C can be made of any appropriate material, including medium- and high-thread-count fabrics of, e.g., cotton or polyester. The layers are sewn, e.g., serged together around the perimeter such that the external top layer 1800C, the foam backing layer 1800D, and the mesh fabric layer 1800E are permanently joined or attached around their entire perimeters, with the foam pieces 1800F positioned in the space between the foam backing layer 1800D and the mesh fabric layer 1800E. The reversible flap 1800B is attached along the three of its four edges that lie adjacent to corresponding edges of the external top layer and those beneath, and the external bottom layer 1800A is permanently attached to the other layers along three of its four edges, the edge that is positioned over the reversible flap remaining unattached to provide an aperture. The resulting structure is similar to the structure of the pillow 1200 described above with reference to FIGS. 12A-12B.

Figure 18C:
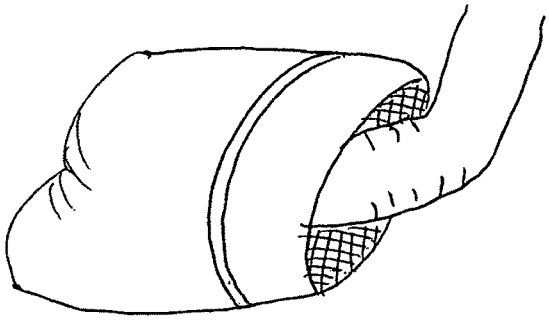
FIGS. 18C-18E show schematic perspective views of a reversible pillow being pulled from the normal-use state to the wash-ready state in accordance with at least one of the various embodiments.
Figure 18D:
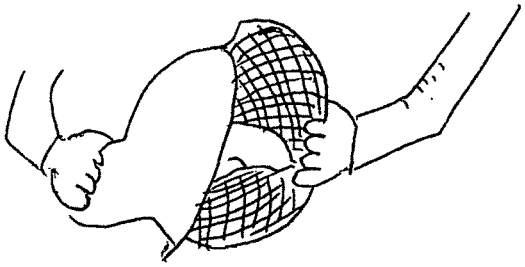
Figure 18E:
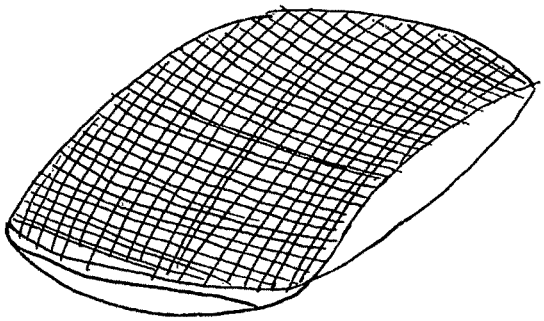

After the layers 1800A-E have been serged together, the pillow 1800 can be reversed to its normal-use state by a user reaching through the aperture between the external bottom layer 1800A and the reversible flap 1800B, grabbing the opposite end of the pillow and pulling the pillow right-side-out. The process can be reversed, as shown in FIGS. 18C and 18D, to its wash-ready state, in which the the mesh fabric layer is exposed, as shown in FIG. 18E. In this configuration, the pillow can be easily and efficiently washed and dried, as described above with reference to other embodiments.

In the illustrated embodiment, the pillow 1800 includes an outer shell case 1801 and a plurality of foam pieces 1800F positioned within an integral inner shell case 1803. In some embodiments, the outer shell case 1801 and 1802 are similar in structure to the the outer shell cases described with reference to FIGS. 2 and 12A-12B.

Figure 18F:
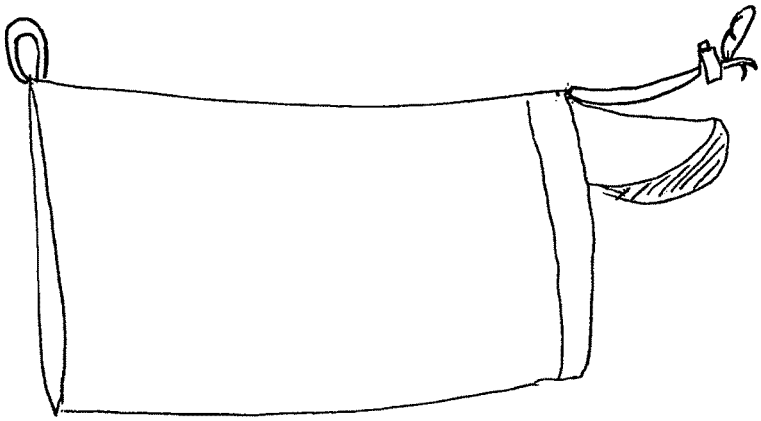
FIGS. 18F-18G show schematic perspective view embodiment of a reversible pillow protective carrying case, both empty and filled with a reversible pillow in accordance with at least one of the various embodiments.
Figure 18G:
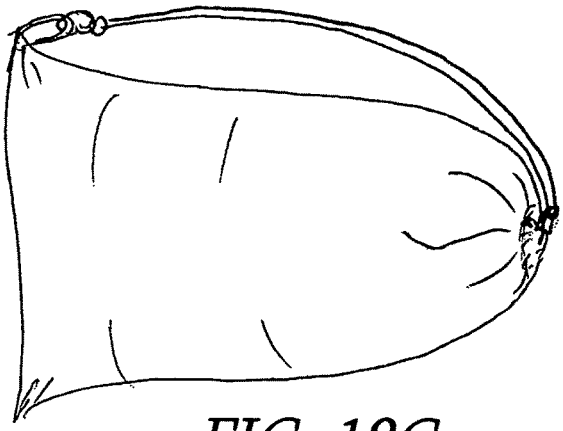

FIGS. 18F and 18G are perspective views of a protective storage case. According to an embodiment, a protective storage case is provided, for the purpose of packing and storing a pillow, in particular the reversible pillow 1800 of FIGS. 1800A-E. Because the inner and outer cases of the pillow 1800 are integrated into a single unit, the volume and weight of material is reduced, as compared to some of the two-part pillows previously described. Consequently, the reversible pillow can more easily be stored and carried in a single, compact stuff bag (FIG. 18G), than the two part removable core pillows. In addition, the storage case (e.g., a water resistant carrying case) may be stored inside the core of the pillow while not in use.

Figure 19:
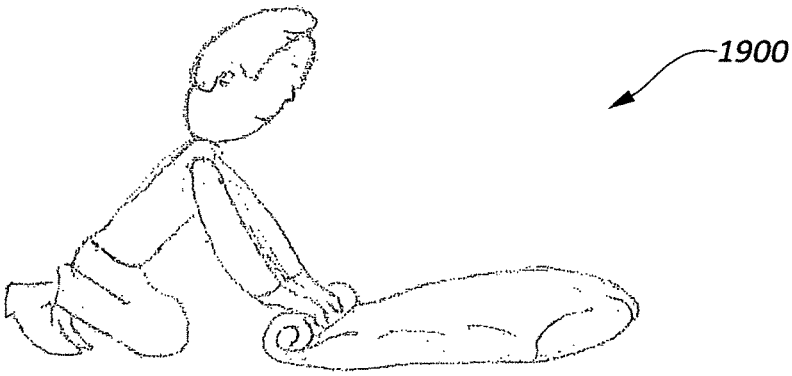
FIG. 19 shows a schematic perspective view of a user rolling up a pillow or inner shell case in accordance with at least one of the various embodiments.
Figure 20:
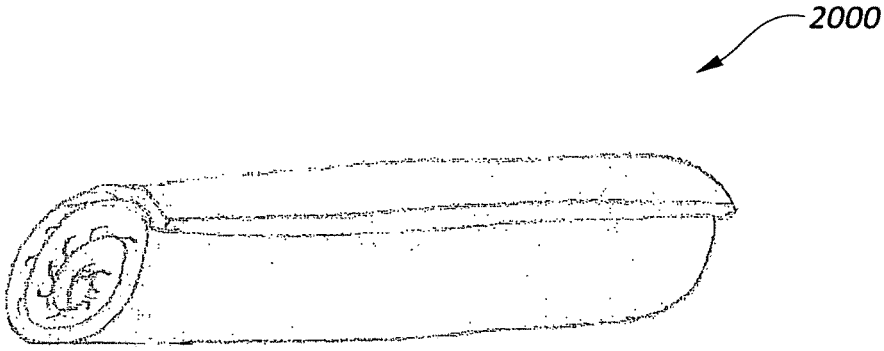
FIG. 20 shows a schematic perspective view of an inner shell case (or pillow) that is rolled up in accordance with at least one of the various embodiments.

FIG. 19 shows a schematic perspective view of a user rolling up a pillow with a reversible case in accordance with at least one of the various embodiments. In some embodiments, a user may roll up two separate inner shell cases (e.g., FIG. 13-16) to be insert into an outer shell case (e.g., outer shell case FIG. 22A-B, FIG. 23A-C and FIG. 18F). An illustration of such a rolled up case is shown in FIG. 20. In other embodiments, the user may roll up a pillow and insert the pillow into a carrying case, such as illustrated in FIG. 19-23.

FIG. 20 shows a perspective view of an inner shell case (or pillow) that is rolled up in accordance with at least one of the various embodiments.

Figure 21:
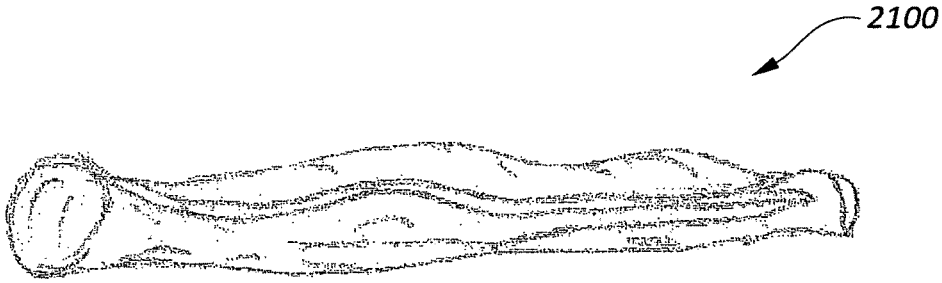
FIG. 21 shows a schematic perspective view of an outer shell case and/or protective carrying case in accordance with at least one of the various embodiments.

FIG. 21 shows a schematic perspective view of an outer shell case and/or protective carrying case in accordance with at least one of the various embodiments.

Figure 22A:
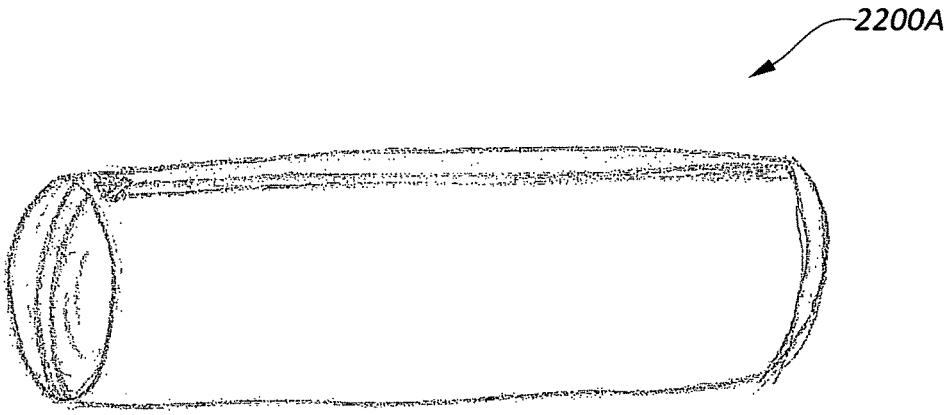
FIGS. 22A-22B show schematic perspective views of a pillow with a protective carrying case in accordance with at least one of the various embodiments.
Figure 22B:
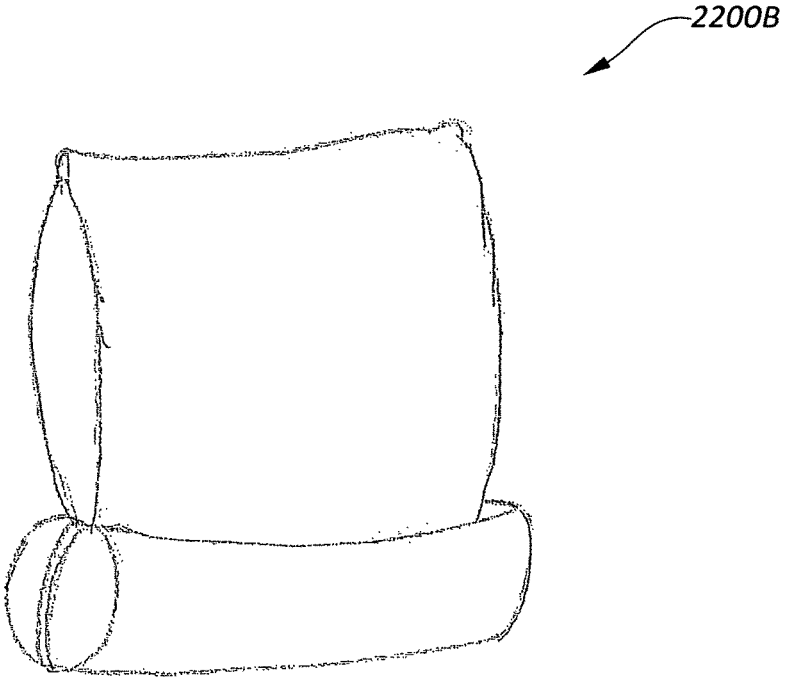

FIGS. 22A-22B show schematic perspective views of a pillow with a protective carrying case in accordance with at least one of the various embodiments. FIG. 22A illustrates the pillow (e.g., pillow 200 of FIG. 2) rolled up and inserted into a carrying case. Although described as being rolled up, embodiments are not so limited and other methods of compacting and/or packing the pillow into a carrying case may be employed. FIG. 22B illustrates pillow 2202 (pillow 2202 is similar in structure to the pillow 200 of FIG. 2) being partially inserted into (or removed from) protective carrying case 2204. In some embodiments, the protective carrying case 2204 may be water resistant and/or water proof so that the entire pillow 2202 can fit into the carrying case. In some embodiments, the pillow 2202 may be connected to carrying case 2204, such as by stitching one edge of pillow 2202 into an inside wall of carrying case 2204.

Figure 23A:
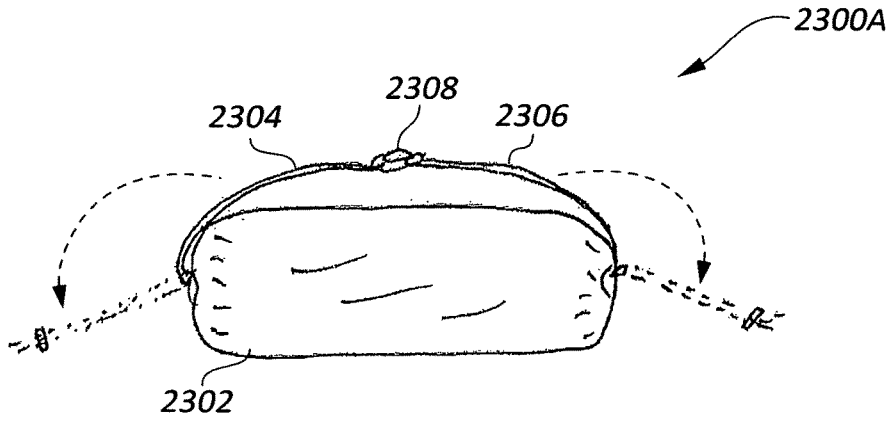
FIGS. 23A-23C show schematic perspective views of a pillow with a protective carrying case in accordance with at least one of the various embodiments.
Figure 23B:
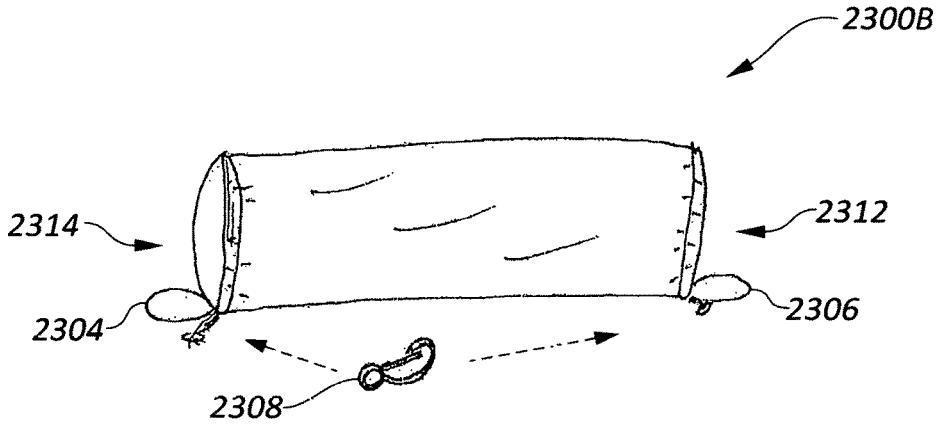
Figure 23C:
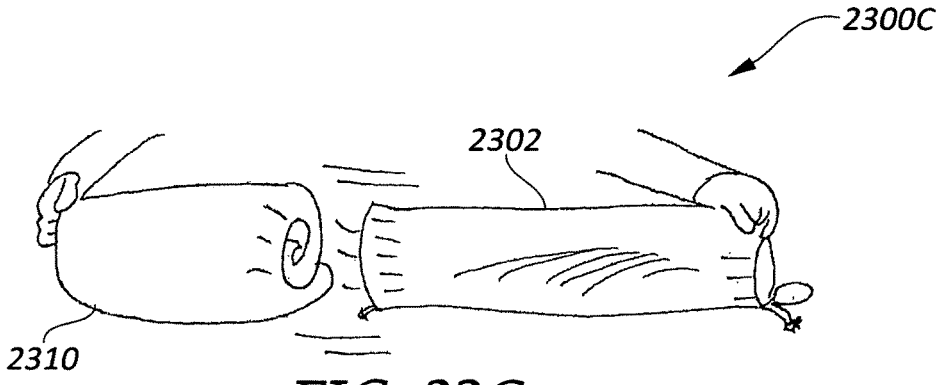

FIG. 23A-23C show schematic perspective views of a pillow with a protective carrying case in accordance with respective embodiments. Example 2300 (illustrated in by examples 2300A, 2300B, and 2300C) illustrates a protective carrying case 2302 and a pillow 2310. In various embodiments, the pillow 2310 includes an inner shell case and an outer shell case, as described with references to other embodiments. In some embodiments, pillow 2310 may have dimensions similar to 45 centimeter by 61 centimeter (or approximately 18 inches by 24 inches), but other dimensions may be used.

In some embodiments, protective carrying case 2302 may be water resistant and/or water proof, or of other suitable material. In at least one of various embodiments, protective carrying case 2302 may be a cylindrical-like shape of suitable size (e.g., a diameter and length suitable to fit pillow 2310, when rolled up). Protective carrying case 2302 may include two open ends that oppose each other, e.g., open ends 2312 and 2314. According to an embodiment, the protective carrying case 2302 includes a pair of drawstrings 2304 and 2306 attached at respective ends 2312 and 2314 of the case. By extending the drawstring away from the body of the protective carrying case, the corresponding end of the protective case can be closed. In some embodiments, when both drawstrings 2304 and 2306 are extended, they can be connected by a latch 2308. Latch 2308 may be a clip or other suitable releasable attachment mechanism that can enable drawstrings 2304 and 2306 to be removably attached to each other, which may create a carrying strap for the protective case (and the pillow).

In various embodiments, a user may be enabled to insert pillow 2310 into protective carrying case 2302 by rolling the pillow into a cylindrical-like shape (e.g., as illustrated in FIGS. 19 and 20). By having dual open ends in the carrying case, pillow 2310 may maintain its cylindrical form when inserted into protective carrying case 2302. Similarly, air inside the protective carrying case can exit through the end opposing the end the pillow is being inserted into, which can ease insertion and removal of the pillow from the protective carrying case.

Example Foam

Figure 24A:
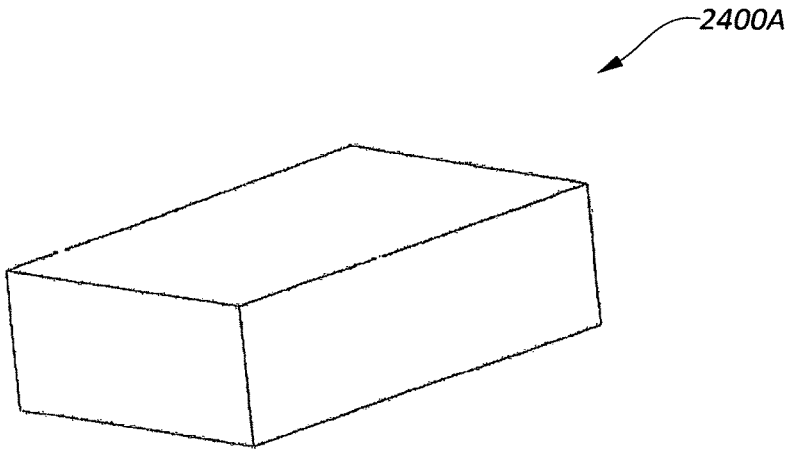
FIGS. 24A-24B show schematic perspective views of various embodiments of a foam block.
Figure 24B:
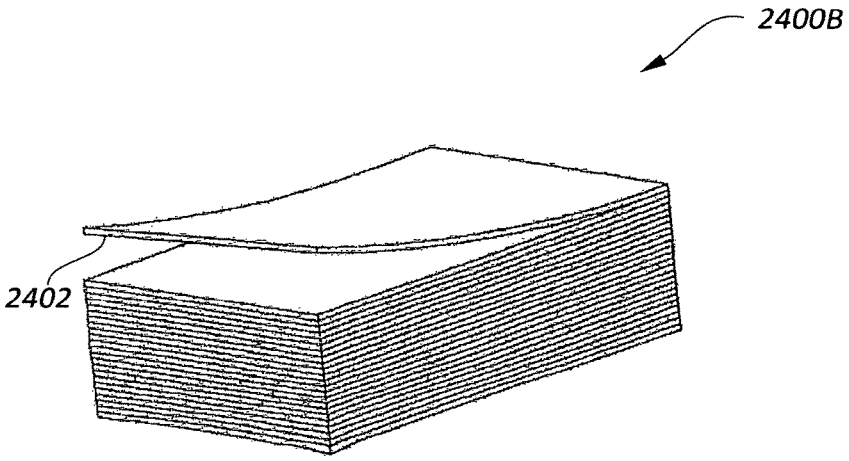

FIG. 24A-24B show schematic perspective views of various embodiments of a foam block that may be utilized in various embodiments. In some embodiments, foam blocks can range in sizes, but can be 4 feet by 2 feet by 8 feet. However, embodiments are not so limited and larger or smaller foam blocks may be used. These foam blocks may be slit or cut into sheets (or foam slices) that can range in size from approximately 2.54 millimeter to 25.4 millimeter (or approximately 0.1 inches to 1 inch). However, embodiments are not so limited and other shapes and/or sizes of foam may be employed. For example, in some other embodiments, the foam may be slit into rolls rather than sheet.

Various foams may be used as the plurality of foam pieces (e.g., foam pieces 210 of FIG. 2) inside the inner shell case (e.g., inner shell case 208 of FIG. 2) or for the backing layer of the outer shell case (e.g., backing layer 204 of FIG. 2). In some embodiments, the foam (e.g., the foam pieces and/or the foam backing) may be made of polyurethane foam or other suitable materials. Various foam cell structures can also be used. For example, in some embodiments, open cell foam can be employed; In other embodiments, closed cell foam may be used; and in yet other embodiments, combinations of closed cell foam and open cell foam may be used. In some embodiments, reticulated foam may also be used.

The foam utilized in the pillow (e.g., plurality of foam pieces inside the inner shell case or for the backing layer of the outer shell case) may have various material properties including, but are not limited to: a density of from about approximately 16.06 kilograms per cubic meter to about 48.06 kilograms per cubic meter (or approximately 1 pound per cubic foot to about 3 pounds per cubic foot); and/or may have an indent force deflection at 10% to 50% of from about 10 to about 75 pounds; a compressive set percentage between 1 to 30 percent; a tensile strength of approximately 0.3515 to 3.164 kilograms per square centimeter (or approximately 5 to 45 pounds per square inch); a tear strength of between approximately 0.294 kilograms per linear centimeter and 3.54 kilograms per linear centimeter (or approximately 0.25 and 3 pounds per linear inch); an elongation percentage of 100 percent or an elongation percentage ranging 90% to 120%; or the like. Foams having other or additional mechanical properties also fall within the present specification. In various embodiments, foam properties may be established using the ASTM D-357486 test method.

Figure 25:
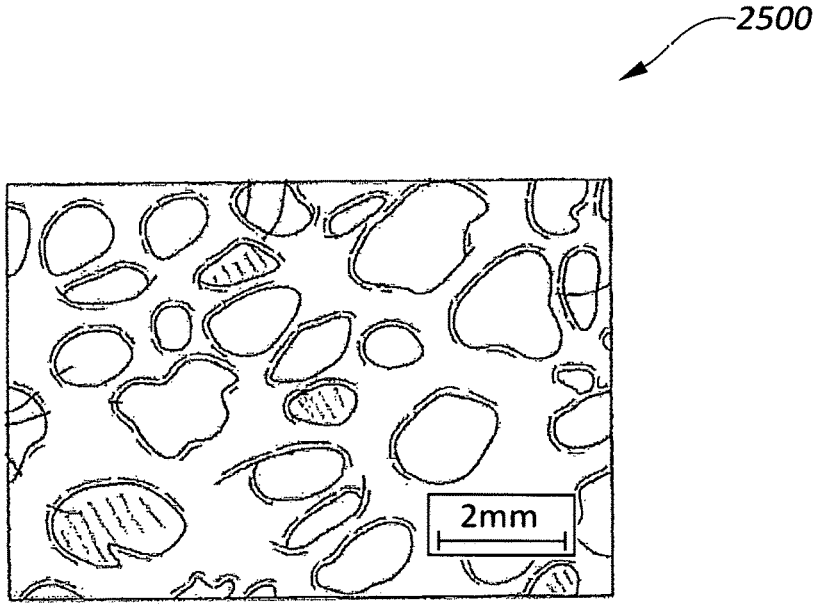
FIG. 25 shows a schematic close-up cross-sectional view of the open cells of foam with a few membranes in some cells in accordance with at least one of the various embodiments.

FIG. 25 shows a schematic close-up cross-sectional view of the open cells of foam with a few membranes in some cells in accordance with at least one of the various embodiments.

FIG. 26A-26D show schematic perspective views of tools for producing foam in accordance with at least one of the various embodiments.

As described herein, the plurality of foam pieces (e.g., foam pieces 210 of FIG. 2) inside the inner shell case may be shaped by various different types of machines and/or processes. For example, in various embodiments, the foam pieces may be precision die cut. In some embodiments, the foam pieces may vary some based on the machine cutting process or variations in a foam cutting machine. For example, assume a foam slice (or a foam panel) is fed into a cutting machine. It may be possible that the first set and/or last set of pieces cut off the foam slice may be shorter or longer than the majority of pieces because of the cutting may not begin at the exact moment the foam slice enters the cutting machine (e.g., misalignment of the start of cutting).

For example, a foam slice or foam block (foam 2602) may be inserted into a die cutting machine. In some embodiments, foam 2602 may be brought to the machine by way of rolls or other methods, rather than individual foam slices. Cutters 2604 may cut foam 2602 into foam pieces 2606, which may drop into container 2610. In some embodiments, foam pieces 2606 may be blown into the inner shell cases. For example, a vacuum may be applied to the machine outlet to collect the cut foam pieces and blow them into the inner shell cases. In some embodiments, a squirrel cage vacuum may be positioned directly into the opening of the inner shell case and blown into the case through an opening approximately 10.16 centimeters to 30.48 centimeters (or approximately 4 inches to 12 inches) wide. This opening may be the entire side of the case if necessary.

Figure 26A:
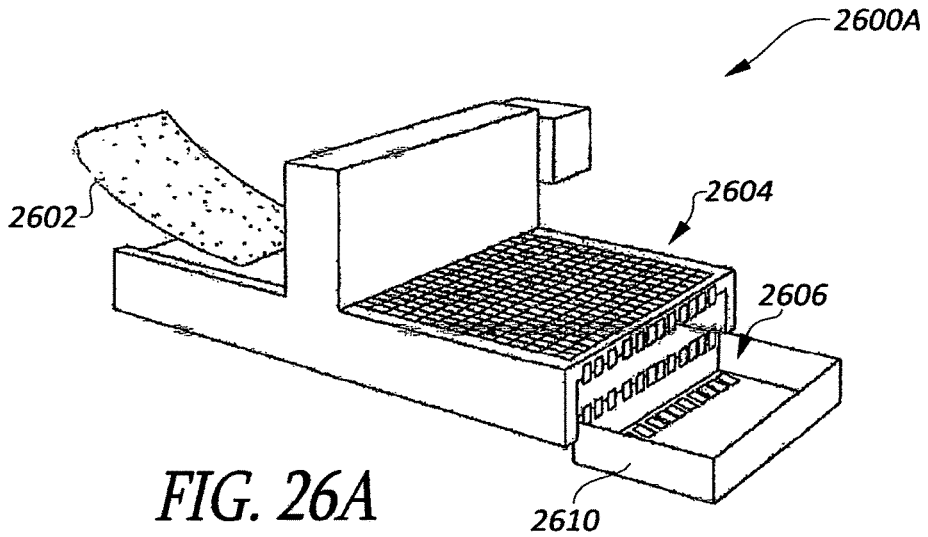
FIGS. 26A-26D show schematic perspective views of tools for producing foam in accordance with at least one of the various embodiments.
Figure 26B:
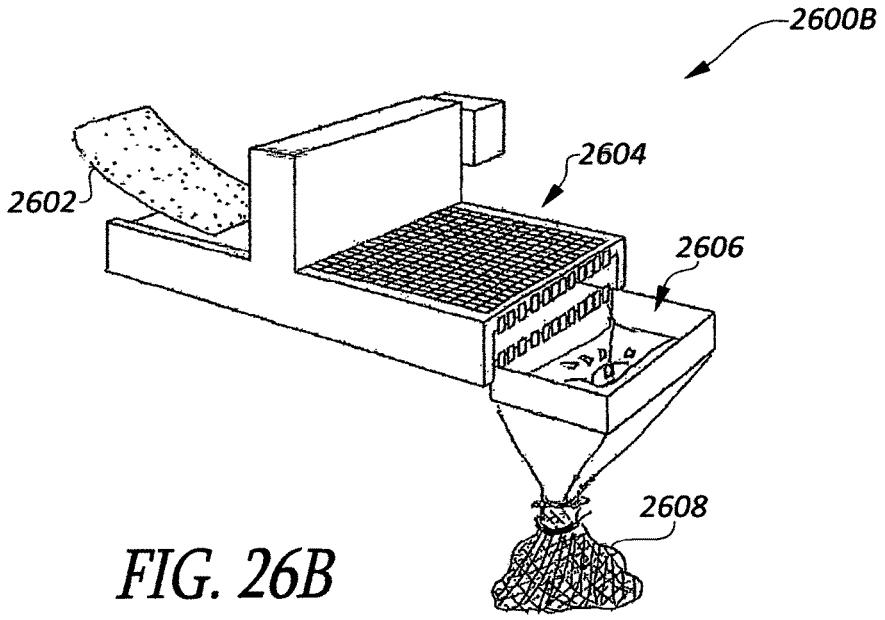
Figure 26C:
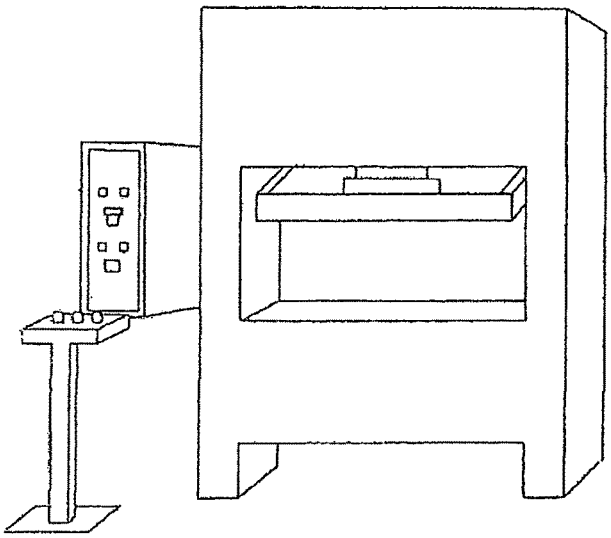
Figure 26D:
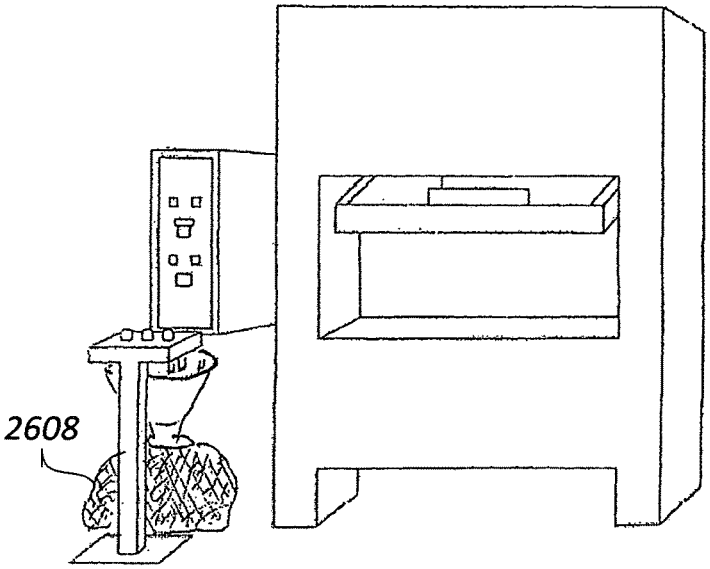

In other embodiments, the foam pieces may be funneled directly into an inner shell case (e.g., case 2608) using a funnel catch at the end of the die cutting assembly line, such as illustrated by of FIG. 26B. In various embodiments, a large open ended funnel can catch the foam pieces coming off the assembly die cut line and feed them directly into the inner shell case attached to the funnel end.

In some embodiments, after the foam pieces are in the inner shell case, the case can be closed by sewing or zipper. In some embodiments, foam pieces may be inserted into an inner shell casing without a zipper and closed by sewing it closed. In other embodiments, foam pieces are inserted into an inner shell case with a zipper and closed by a zippered close. In at least one embodiment, the zipper pull may be cut off to prevent easy opening of the inner shell case. This zipper pull removal provides a layer of safety so that the foam pieces do not accidently fall out. In some embodiments, the zipper may still function, such that a paperclip or other household items may be used to release the zipper if needed (e.g., to add or remove some foam pieces to change the compressibility of the pillow).

In at least one of various embodiments, the tool used (such as illustrated in FIG. 26A-26D) may be various apparatuses capable of producing foam usable with the present subject matter. However, other processes or machines for producing foam and/or pillows may be employed. In some embodiments, foam blocks of approximately 10.16 centimeters by 5.08 centimeters by 20.32 centimeters (or approximately 4 inches by 2 inches by 8 inches) may be employed. In one embodiment, these foam blocks are slit into sheets (or foam slices) that can range in thickness from approximately 0.254 centimeters to 2.54 centimeters (or approximately 0.1 inches to 1 inch).

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and various embodiments, will be apparent to those of skill in the art upon reviewing the above description.

The above specification, examples, and information provide a complete description of the manufacture and use of the composition of the invention. Since many embodiments can be made without departing from the spirit and scope of the invention, the invention resides in the claims hereinafter appended.

What is claimed is:

1. A pillow assembly, including a pillow comprising:

a first external fabric layer;

a mesh layer coupled to the first external fabric layer around an entire perimeter of the mesh layer;

a pillow fill positioned in a space between the first external fabric layer and the mesh layer and including a plurality of pillow fill pieces;

a second external fabric layer permanently coupled to the first external fabric layer around three sides of a perimeter of the second external fabric layer; and an aperture opening into a space between the second external fabric layer and the mesh layer, sized and configured to permit reversal of the pillow, via the aperture, between a normal-use state, in which the mesh layer is positioned between the first external fabric layer and the second external fabric layer, and a wash-ready state, in which the first external fabric layer is positioned between the second external fabric layer and the mesh layer.

2. The pillow assembly of claim 1 wherein the mesh layer and the second external fabric layer are sewn to the first external fabric layer.

3. The pillow assembly of claim 1 wherein the second external fabric layer is permanently coupled to the first external fabric layer around the three sides of the perimeter of the second external fabric layer, a fourth side of the perimeter being unattached.

4. The pillow assembly of claim 1 wherein the aperture comprises a portion of a fourth side of the perimeter of the second external fabric layer that is not coupled to the first external fabric layer.

5. The pillow assembly of claim 1 wherein the pillow comprises a reversible flap coupled to the first external fabric layer, positioned and configured to be reversible between a first flap position, in which the aperture is covered by the flap, and a second flap position, in which the aperture is not covered by the flap.

6. The pillow assembly of claim 1 wherein the pillow fill comprises a plurality of foam pieces.

7. The pillow assembly of claim 6 wherein each of the plurality of foam pieces is defined by cleanly cut edges.

8. The pillow assembly of claim 6 wherein the mesh layer comprises a mesh having a plurality of mesh openings, and wherein each of the plurality of foam pieces is sized such that it cannot pass through any one of the mesh openings.

9. The pillow assembly of claim 1 wherein the pillow comprises a backing layer coupled to the first external fabric layer and positioned between the the first external fabric layer and the mesh layer.

10. The pillow assembly of claim 9 wherein the backing layer comprises a foam backing layer.

11. The pillow assembly of claim 1, comprising a protective storage case configured to receive the pillow therein.

12. The pillow assembly of claim 11 wherein the protective storage case includes a fabric cylinder having a drawstring closure at each end thereof.

13. The pillow assembly of claim 1 wherein the mesh layer and the second external fabric layer are serged to the first external fabric layer.

14. The pillow assembly of claim 1 wherein the pillow fill is permanently captured between the mesh layer and the first external fabric layer.

15. The pillow assembly of claim 1 wherein the mesh layer includes an access passage configured to permit access to the space between the first external fabric layer and the mesh layer.

16. A method, comprising:

reversing a pillow from a normal-use state, in which a pillow fill, including a plurality of fill pieces enclosed in a space between a first external fabric layer and a mesh layer, is positioned inside the pillow between the first external fabric layer and a second external fabric layer that is permanently coupled to the first external fabric layer around three sides of a perimeter of the second external fabric layer, to a wash-ready state, in which the pillow fill is positioned outside the pillow while remaining enclosed within the space between the first external fabric layer and the mesh layer, including:

reaching into the pillow through an aperture and into a space between the second external fabric layer and the mesh layer; and pulling the pillow inside-out through the aperture.

17. The method of claim 16, comprising, prior to reaching into the pillow, uncovering the aperture, including reversing a flap that is positioned over the aperture.

18. The method of claim 16, comprising:

while the pillow is in the wash-ready state, washing the pillow, including flowing washing fluids through and around the plurality of fill pieces via the mesh layer; and drying the pillow, including flowing air through and around the plurality of fill pieces via the mesh layer.

19. The method of claim 18, comprising:

following performance of the steps of washing the pillow and drying the pillow, reversing the pillow from the wash-ready state to the normal-use state, including:

reaching into the pillow through the aperture and into a space between the first external fabric layer and the second external fabric layer; and pulling the pillow right-side-out through the aperture.

20. The method of claim 19, comprising:

following performance of the step of pulling the pillow right-side-out through the aperture, covering the aperture, including re-reversing the flap.

* * * * *